US009222225B2

(12) United States Patent
Wang et al.

(10) Patent No.: US 9,222,225 B2
(45) Date of Patent: Dec. 29, 2015

(54) PRE-STRESSED CONCRETE TRACK SLAB OF SLAB-TYPE BALLAST-LESS TRACK

(75) Inventors: Jijun Wang, Beijing (CN); Cheng Jiang, Beijing (CN); Weibin Liu, Beijing (CN); Yong Zhao, Beijing (CN); Meng Wang, Beijing (CN); Ziqing Jiang, Beijing (CN); Jia Fan, Beijing (CN); Xianggang Du, Beijing (CN); Lu Chunfang, Beijing (CN)

(73) Assignee: Railway Engineering Research Institute of China Academy of Railway Sciences, Beijing (CN)

( * ) Notice: Subject to any disclaimer, the term of this patent is extended or adjusted under 35 U.S.C. 154(b) by 221 days.

(21) Appl. No.: 13/994,931

(22) PCT Filed: Dec. 15, 2011

(86) PCT No.: PCT/CN2011/084072

§ 371 (c)(1),
(2), (4) Date: Jun. 17, 2013

(87) PCT Pub. No.: WO2012/079526

PCT Pub. Date: Jun. 21, 2012

(65) Prior Publication Data

US 2013/0264394 A1 Oct. 10, 2013

(30) Foreign Application Priority Data

Dec. 17, 2010 (CN) ..... 2010 2 0665862 U
Dec. 31, 2010 (CN) ..... 2010 2 0691768 U

(51) Int. Cl.
*E01B 1/00* (2006.01)
*E01B 3/40* (2006.01)

(52) U.S. Cl.
CPC .. *E01B 1/002* (2013.01); *E01B 3/40* (2013.01)

(58) Field of Classification Search
CPC ..... E01B 1/002–1/007
USPC ..... 238/2, 7
See application file for complete search history.

(56) References Cited

U.S. PATENT DOCUMENTS 3,382,815 A * 5/1968 Higuchi et al. ..... 104/3
3,656,690 A * 4/1972 Hanig ..... 238/2

(Continued)

FOREIGN PATENT DOCUMENTS

CN 201347522 11/2009
CN 201883346 6/2011

(Continued)

OTHER PUBLICATIONS

Ding, Yi, Google translation of article; 5 pages; matters needing attention of construction of cement emulsified bituminous mortar Science and Techonolgy Innovation Herald; Oct. 4, 2010 (with machine translation).

*Primary Examiner* — Zachary Kuhfuss
(74) *Attorney, Agent, or Firm* — Renner Kenner Greive Bobak Taylor & Weber

(57) ABSTRACT

Provided in the disclosure is a pre-stressed concrete track slab of slab-type ballast-less track, which includes a slab body (1), on which fastening embedded casings (4) are arranged. At least one row of longitudinal common steel bars (11) and at least one row of transverse common steel bars (12) are arranged in the slab body (1) along a length direction and a width direction. The longitudinal common steel bars (11) are insulated from the transverse common steel bars (12). At least one row of longitudinal pre-stressed steel bars (7) and at least one row of transverse pre-stressed steel bars (6) are fastened in the slab body (1) along the length direction and the width direction through anchor backing plates and fastener devices (8). In the pre-stress directions of the longitudinal pre-stressed steel bars (7) and the transverse pre-stressed steel bars (6), it is post-tensioned in both directions or it is pre-tensioned in one direction and post-tensioned in the other direction. Limiting structures (5) and grounding terminals (10) are also arranged on the slab body (1). The pre-stressed concrete track slab has the characteristics of light structural dead weight, small structure height, low manufacturing cost and deformation resistance.

9 Claims, 6 Drawing Sheets

(56) References Cited

U.S. PATENT DOCUMENTS

| | | | | |
|---|---|---|---|---|
| 4,290,991 | A * | 9/1981 | Thim | 264/157 |
| 4,703,890 | A * | 11/1987 | Tognoli et al. | 238/7 |
| 5,312,038 | A * | 5/1994 | Merlanti et al. | 238/7 |
| 6,237,856 | B1 * | 5/2001 | Bachmann et al. | 238/7 |
| 8,636,441 | B2 * | 1/2014 | French | B28B 7/186 404/45 |
| 8,727,229 | B2 * | 5/2014 | Qi et al. | 238/85 |
| 2008/0116290 | A1 * | 5/2008 | Freudenstein | 238/2 |
| 2008/0230621 | A1 * | 9/2008 | Bogl | 238/25 |
| 2014/0203094 | A1 * | 7/2014 | Lu et al. | 238/2 |

FOREIGN PATENT DOCUMENTS

| | | |
|---|---|---|
| CN | 201915299 | 8/2011 |
| JP | 9268501 | 10/1997 |

* cited by examiner

PRE-STRESSED CONCRETE TRACK SLAB OF SLAB-TYPE BALLAST-LESS TRACK

TECHNICAL FIELD OF THE INVENTION

The disclosure relates to a track slab which can be widely applied to high speed railways, dedicated passenger lines, ordinary railways, and urban and intercity transportation, e.g. a pre-stressed concrete track slab of slab-type ballast-less track and a pre-tensioning pre-stressed concrete track slab of slab-type ballast-less track.

BACKGROUND OF THE INVENTION

The total mileage of railways in operation in China will reach 100 thousand kilometers by 2020, and "four vertical lines and four horizontal lines" of express dedicated passenger lines as well as three express intercity rail transportation systems will be constructed to achieve separation of passenger transportation and freight transportation practiced on busy main lines. Safe and comfortable running of dedicated passenger lines requires higher track regularity and stability, and brings profound technical renovation to track facilities in China.

At present, ballast tracks are generally applied to railways in China. The ballast beds of ballasted tracks gradually become loose due to being repeatedly passed by trains, thus resulting in poor irregularity and a great deal of maintenance work. In addition, the development of increasing the speed of railway is hindered by the workload and time required by maintenance.

France, which is a country with high-speed railways with ballasted tracks as the representative, has always been proud of the ballasted tracks operating at 270 km/h to 300 km/h. However, it's found later that railway ballast of the southeast line and Atlantic line early established is pulverized seriously. The geometric dimensions of the tracks are hardly maintained. Maintenance periods are shortened, maintenance costs are largely increased, and even normal operation is affected. Complete overhaul has to be performed and the railway ballast has to be replaced until it is even operated for less than a decade.

Ballast-less track technology has been developed maturely in the countries mainly comprising Germany and Japan. The slab-type tracks in Japan have relatively unified constructions which however have structures and dimensions slightly different for different line grades, different natural conditions, different basic conditions, and different train speeds and operating conditions. The slab-type tracks are classified into certain types which currently include a common A type, a frame type and a practical vibration reduction G type applied in special vibration reduction sections etc.

Ballast-less tracks have been researched in China since the 1960s which was as early as abroad. Supporting block-type integrated ballast beds, short wooden sleeper-type integrated ballast beds, and integrally cast integrated ballast beds etc., frame type asphalt ballast beds and the beds of many other types were applied in trial laying at the preliminary stage. Supporting block-type ballast-less tracks which are about 300 km long used to be laid in tunnels of the Chengdu-Kunming Line, the Beijing-Yuanping Line, the Beijing-Tongliao Line and the Southern Xinjiang Line. Afterwards, asphalt concrete ballast-less tracks consisting of asphalt concrete pavement layers and wide sleepers were applied in trial laying only in large-scale passenger railway stations and tunnels. Ballast-less structures without sleepers also used to be laid on the Jiujiang Yangtze River Bridge of the Beijing-Kowloon Line.

Currently, high-speed railways, dedicated passenger lines, as well as urban and intercity transportation in China are constructed step by step. Since trains are operating at higher speed with less maintenance time, adequate consideration should be taken to achieve comfortable, stable, and durable ballast-less tracks with less maintenance.

Ballast-less track systems are applied to most high-speed railways all over the world, and there are two major types of ballast-less tracks, i.e. slab-type ballast-less tracks and double-block type ballast-less tracks. Compared with ballast-less tracks of the double-block type, slab-type ballast-less tracks with post-tensioned track slabs in Japan and Bögl slabs in Germany as the representative are evidently advantageous.

High speed railway ballast-less tracks have been developed rapidly since post-tensioned track slabs were applied to the Qinhuangdao-Shenyang Line and the Suining-Chongqing Line on trial and then Bögl slabs were applied to the Beijing-Tianjing intercity high-speed railway. It's proven by engineering practice that these two kinds of track slabs have evident disadvantages and need to be improved.

SUMMARY OF THE INVENTION

The disclosure aims to provide a track slab having light structural dead weight, small structure height, and low manufacturing cost and having deformation resistance, which is applicable to a railway track circuit, e.g. a pre-stressed concrete track slab of slab-type ballast-less track and a pre-tensioning pre-stressed concrete track slab of slab-type ballast-less track.

In order to achieve the purposes above, according to an aspect of the disclosure, a pre-stressed concrete track slab of slab-type ballast-less track is provided, including: a slab body, on which embedded casings for the fastenings are arranged. At least one row of longitudinal common steel bars and at least one row of transverse common steel bars are arranged in the slab body along a length direction and a width direction. The longitudinal common steel bars are insulated from the transverse common steel bars. At least one row of longitudinal pre-stressed steel bars and at least one row of transverse pre-stressed steel bars are fastened in the slab body along the length direction and the width direction through anchor backing plates and fastener devices. In the pre-stress directions of the longitudinal pre-stressed steel bars and the transverse pre-stressed steel bars, it is post-tensioned in both directions, or it is pre-tensioned in one direction and post-tensioned in the other direction. And further limiting structures and grounding terminals are arranged on the slab body.

According to another aspect of the disclosure, a pre-tensioning pre-stressed concrete track slab of slab-type ballast-less track is provided, including: a slab body, on which embedded casings for the fastenings are arranged. At least one row of longitudinal common steel bars and at least one row of transverse common steel bars are arranged in the slab body along a length direction and a width direction. The longitudinal common steel bars are insulated from the transverse common steel bars. At least one row of longitudinal pre-stressed steel bars and at least one row of transverse pre-stressed steel bars are further provided in the slab body along the length direction and the width direction. In the pre-stress directions of the longitudinal pre-stressed steel bars and the transverse pre-stressed steel bars, it is pre-tensioned in both directions. And further limiting structures and grounding terminals are arranged on the slab body.

According to another aspect of the disclosure, a track slab is provided, including: a slab body. At least one row of longitudinal steel bars and at least one row of transverse steel bars are arranged in the slab body along a length direction and a width direction. The longitudinal steel bars are insulated from the transverse steel bars. At least one row of longitudinal pre-stressed steel bars and at least one row of transverse pre-stressed steel bars are further provided in the slab body along the length direction and the width direction. And further limiting structures and grounding terminals are arranged on the slab body.

Because of the application adopting the technical scheme above, the disclosure has the following characteristics:

1. The pre-stressed concrete track slab of slab-type ballast-less track and the pre-tensioning pre-stressed concrete track slab of slab-type ballast-less track of the disclosure are convenient to adhere elastic pads to bottom of the slab so as to achieve vibration reduction for bottom foundations; a transition section between a ballasted track and a ballast-less track is convenient to lay an auxiliary rail on a concrete track slab to increase the vertical bending rigidity of a track sleeper; the concrete track slab, which is light in dead weight and small in structure height may be pre-stressed (pre-stress directions are set such that the concrete track slab is post-tensioned in both directions or pre-tensioned in one direction and post-tensioned in the other direction, or pre-tensioned in both directions) to ensure that the concrete does not crack under the design load; and requirements on safety and riding comfort of high-speed heavy haul trains can be satisfied. At the same time, for the technical scheme of pre-tensioning in both directions by means of pre-stressing, the problem of relatively high construction cost of an anchor of a post-tensioned track slab etc. can be solved through applying a pre-tensioning pre-stress in both directions;

2. Longitudinal common steel bars and transverse common steel bars are arranged in the pre-stressed concrete track slab of slab-type ballast-less track and the pre-tensioning pre-stressed concrete track slab of slab-type ballast-less track of the disclosure. Measures including resin steel or insulating coatings or insulating fasteners etc. can be applied to satisfy technical requirements of track circuit insulation, thus solving the conflict between the slab-type ballast-less track and a railway signal system and satisfying technical requirements of track circuits. In addition, compared with other structures, the manufacturing process is simple and convenient, and the quality can be ensured easily during a process of applying an insulation method. The longitudinal common steel bars and the transverse common steel bars can be bound into reinforced nets that are convenient to be molded integrally, which can increase the locating accuracy of the steel bars and save production time;

3. The pre-stressed concrete track slab of slab-type ballast-less track and the pre-tensioning pre-stressed concrete track slab of slab-type ballast-less track of the disclosure which have light dead weight, small structure height and low manufacturing cost, can be conveniently transported and paved. Buckling of track slabs can be hardly affected by daily temperature differences and the amount of material applied in filling layers is reduced;

4. The pre-stressed concrete track slab of slab-type ballast-less track and the pre-tensioning pre-stressed concrete track slab of slab-type ballast-less track of the disclosure can be provided with support rail beds on surfaces of the track slab to adjust drainage of snow and rainwater in cold regions, reduce damage of fastenings in windy and sandy areas as well as salty soil areas, and facilitate maintenance etc.

BRIEF DESCRIPTION OF THE DRAWINGS

The accompanying drawings which constitute a part of the present application are used for providing further understanding to the disclosure. The exemplary embodiments of the disclosure and the illustrations thereof are used for explaining the disclosure, instead of constituting an improper limitation to the disclosure. In the accompanying drawings.

DETAILED DESCRIPTION OF THE EMBODIMENTS

It should be noted that, if there is no conflict, the embodiments of the present application and the characteristics in the embodiments can be combined with one another. The disclosure will be described in detail below with reference to the accompanying drawings and in combination with the embodiments.

Figure 1:
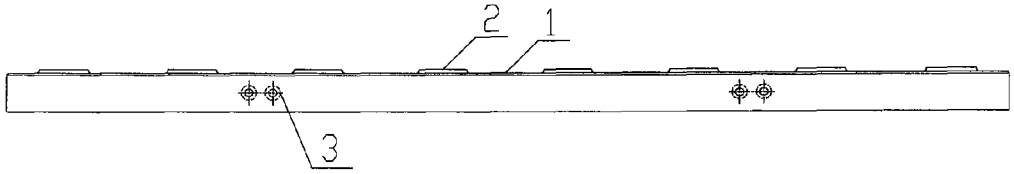
FIG. 1 is a front view structural schematic diagram of the first embodiment of the pre-stressed concrete track slab of slab-type ballast-less track of the disclosure.
Figure 2:
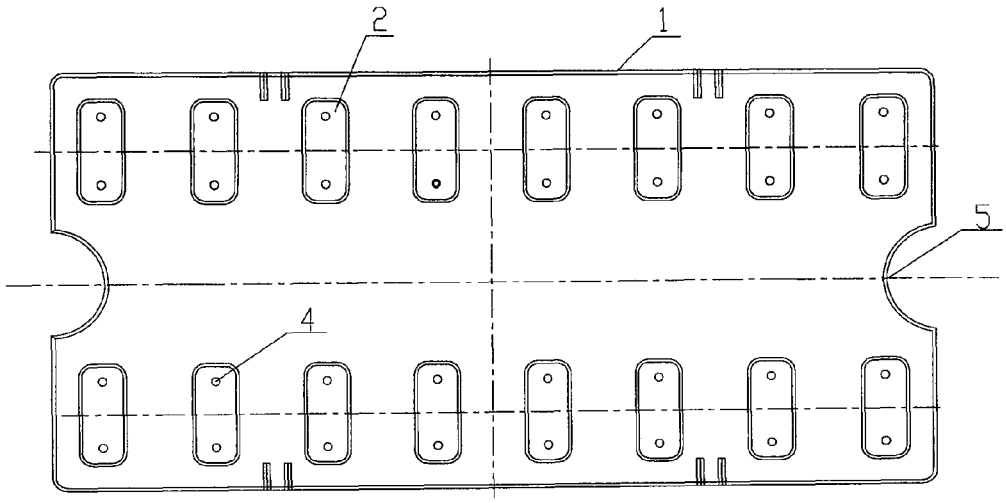
FIG. 2 is a top view structural schematic diagram of the first embodiment of the pre-stressed concrete track slab of slab-type ballast-less track of the disclosure.
Figure 3:
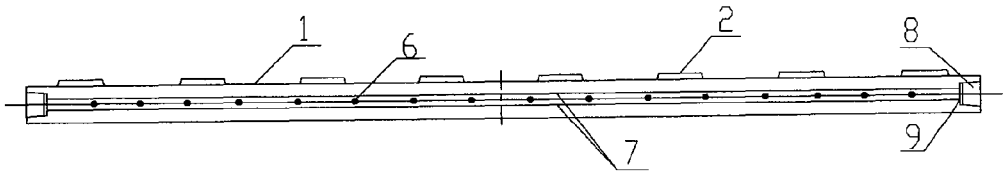
FIG. 3 is a schematic diagram illustrating a pre-stressed steel bar in the first embodiment of the pre-stressed concrete track slab of slab-type ballast-less track of the disclosure.
Figure 4:
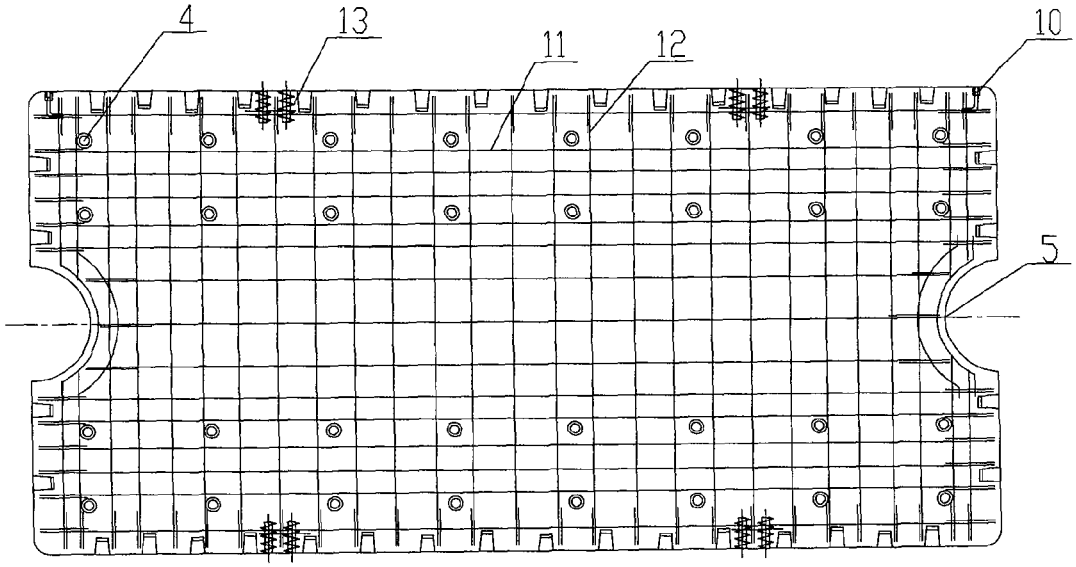
FIG. 4 is a schematic diagram illustrating a common steel bar in the first embodiment of the pre-stressed concrete track slab of slab-type ballast-less track of the disclosure.
Figure 5:
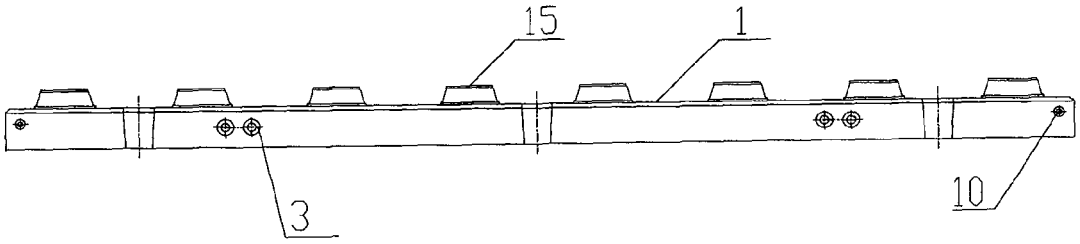
FIG. 5 is a front view structural schematic diagram of the second embodiment of the pre-stressed concrete track slab of slab-type ballast-less track of the disclosure.
Figure 6:
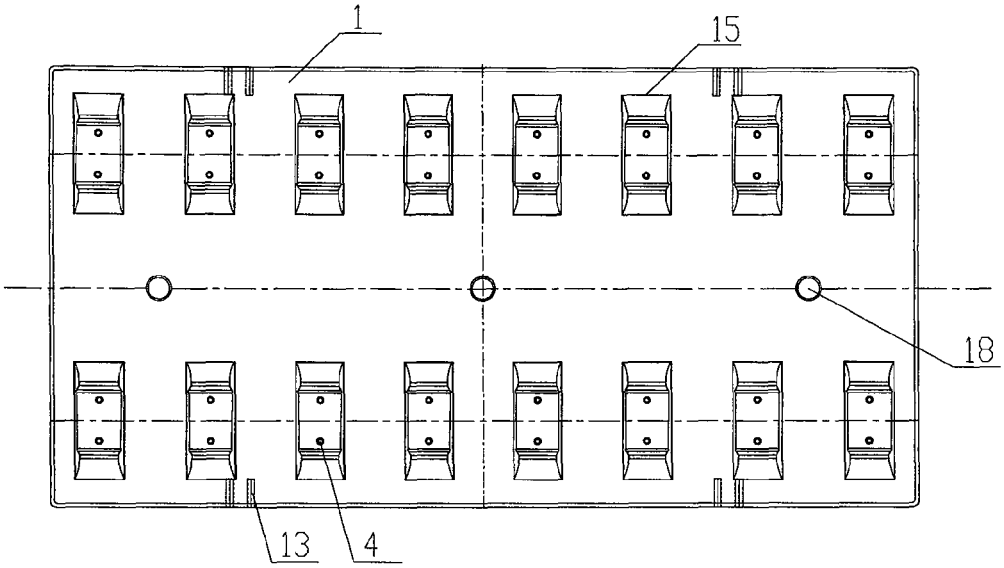
FIG. 6 is a top view structural schematic diagram of the second embodiment of the pre-stressed concrete track slab of slab-type ballast-less track of the disclosure.
Figure 7:
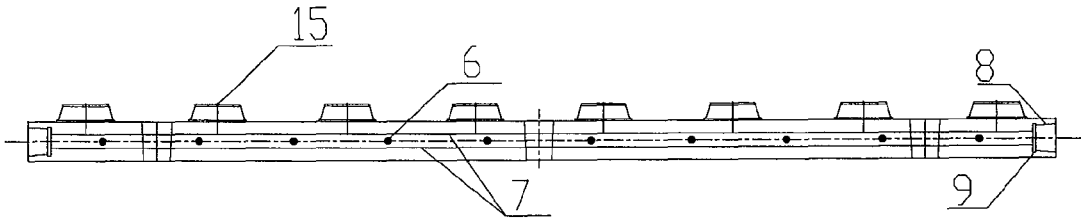
FIG. 7 is a schematic diagram illustrating a pre-stressed steel bar in the second embodiment of the pre-stressed concrete track slab of slab-type ballast-less track of the disclosure.
Figure 8:
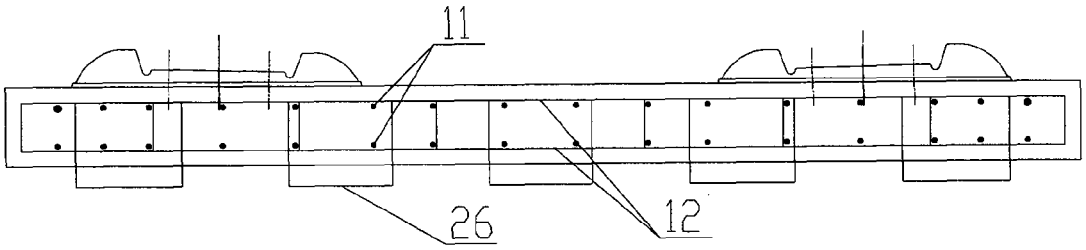
FIG. 8 is a schematic diagram illustrating a common steel bar in the second embodiment of the pre-stressed concrete track slab of slab-type ballast-less track of the disclosure.

The First Embodiment of the Pre-Stressed Concrete Track Slab of Slab-Type Ballast-Less Track FIG. 1 to FIG. 4 are structural schematic diagrams of the first embodiment of a pre-stressed concrete track slab of slab-type ballast-less track of the disclosure. As shown in the figures, the pre-stressed concrete track slab of slab-type ballast-less track of the disclosure includes: a slab body 1. Fastening embedded casings 4 are arranged on the slab body 1. The distance between fastenings of the steel rail may be regulated by regulating the positions of the fastening embedded casings 4 to adapt to requirements of different operation conditions. At least one row of longitudinal common steel bars 11 and at least one row of transverse common steel bars 12 are arranged in the slab body 1 along a length direction and a width direction. At least one row of longitudinal pre-stressed steel bars 7 and at least one row of transverse pre-stressed steel bars 6 are fastened in the slab body 1 along the length direction and the width direction through anchor backing plates 9 and fastener devices 8. In the pre-stress directions of the longitudinal pre-stressed steel bars 7 and the transverse pre-stressed steel bars 6, it is post-tensioned in both directions or it is pre-tensioned in one direction and post-tensioned in the other direction. Preferably, the anchor backing plates 9 are provided at transverse ends and/or longitudinal ends of the slab body. Support rail beds 2 are further provided on the slab body 1. The support rail beds 2 and the slab body 1 may be cast integrally during manufacturing. In order to improve the intensities of anchor holes, spiral reinforcements are further provided in concrete around the anchor backing plates 9 and the fastener devices 8. The common steel bars 11, 12 may be insulated with each other through measures including resin steel bars, or insulating coatings or insulating fasteners etc. In addition, grounding terminals 10 are further provided at the common steel bars to satisfy technical requirements of track circuit insulation, wherein the resin steel bars are steel bars provided with resin coatings on the outer surfaces. As shown in FIG. 4, the grounding terminals 10 are connected with an upper row of the common steel bars 11. In the first embodiment, there is one row of the longitudinal common steel bars 11 and one row of the transverse common steel bars 12. However, multiple rows of the longitudinal common steel bars 11 and the transverse common steel bars 12 may be arranged if necessary. Similarly, multiple rows of the longitudinal pre-stressed steel bars 7 and the transverse pre-stressed steel bars 6 may be arranged if necessary. The longitudinal pre-stressed steel bars 7 and the transverse pre-stressed steel bars 6 may be steel rods, steel wires or steel strands. In addition, the grounding terminals 10 as illustrated in the figure are connected with the upper row of the common steel bars 11. However, it is also possible that the grounding terminals 10 may be connected with a lower row of common steel bars. Further, at least one group of hoisting casings 3 is along the length direction, provided respectively at both sides of the slab body 1 with respect to the width direction, oppositely. In order to improve the intensities of the hoisting casings 3 and surrounding concrete thereof, spiral reinforcements 13 are further provided in concrete around the hoisting casings 3. Both shorter edges of the slab body 1 are further provided with semicircular gaps 5 configured to locate, as well as longitudinally and transversely limit the slab body 1 during line installation.

The Second Embodiment of the Pre-Stressed Concrete Track Slab of Slab-Type Ballast-Less Track FIG. 5 to FIG. 8 are structural diagrams of the second embodiment of a pre-stressed concrete track slab of slab-type ballast-less track of the disclosure. As shown in FIG. 5 to FIG. 8, the pre-stressed concrete track slab of slab-type ballast-less track of the disclosure includes: a slab body 1. Fastening embedded casings 4 are arranged on the slab body 1. The distance between fastenings of the steel rail may be regulated by regulating the positions of the fastening embedded casings 4 to adapt to requirements of different operation conditions. At least one row of longitudinal common steel bars 11 and at least one row of transverse common steel bars 12 are arranged in the slab body 1 along a length direction and a width direction. At least one row of longitudinal pre-stressed steel bars 7 and at least one row of transverse pre-stressed steel bars 6 are tightly fixed in the slab body 1 along the length direction and the width direction through anchor backing plates 9 and fastener devices 8. In the pre-stress directions of the longitudinal pre-stressed steel bars 7 and the transverse pre-stressed steel bars 6, it is post-tensioned in both directions or pre-tensioned in one direction and post-tensioned in the other direction. Concrete shoulders 15 are further provided on the slab body 1. The concrete shoulders 15 and the slab body 1 may be cast integrally during manufacturing. In order to improve the intensities of anchor holes, spiral reinforcements are further provided in concrete around the anchor backing plates 9 and the fastener devices 8. For the common steel bars 11, 12, measures may be applied including resin steel bars, or insulating coatings or insulating fasteners etc. In addition, grounding terminals 10 are further provided at the common steel bars to satisfy technical requirements of track circuit insulation, wherein the resin steel bars are steel bars provided with resin coatings on the outer surfaces. In the first embodiment, there is one row of the longitudinal common steel bars 11 and one row of the transverse common steel bars 12. However, multiple rows of the longitudinal common steel bars 11 and the transverse common steel bars 12 may be arranged if necessary. Similarly, multiple rows of the longitudinal pre-stressed steel bars 7 and the transverse pre-stressed steel bars 6 may be arranged if necessary. The longitudinal pre-stressed steel bars 7 and the transverse pre-stressed steel bars 6 may be steel rods, steel wires or steel strands. In addition, further, at least one group of hoisting casings 3 is along the length direction provided respectively at both sides of the slab body 1 with respect to the width direction, oppositely. In order to improve the intensities of the hoisting casings 3 and surrounding concrete thereof, spiral reinforcements 13 are further provided in concrete around the hoisting casings 3. Steel bars 26, which extend out of the bottom of the slab body 1, are used to locate, and longitudinally and transversely limit the slab body 1 during line installation. At least one pouring hole 18 for a filling layer, penetrating through the slab body 1, is further provided on the slab body 1 and concrete is poured through the pouring hole 18 to fix the steel bars 26 which extend out.

The Third Embodiment of the Pre-Stressed Concrete Track Slab of Slab-Type Ballast-Less Track The structure in the third embodiment is basically the same as that in the first embodiment, and the same parts will not be repeated. The difference between the third embodiment and the first embodiment will be mainly described below.

Figure 9:
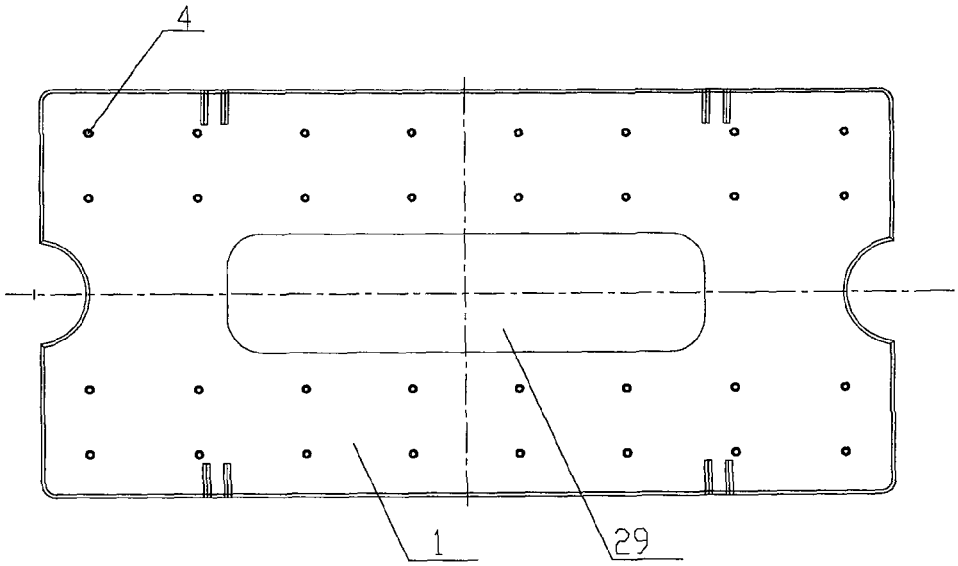
FIG. 9 is a top view structural schematic diagram of the third embodiment of the pre-stressed concrete track slab of slab-type ballast-less track of the disclosure.
Figure 10:
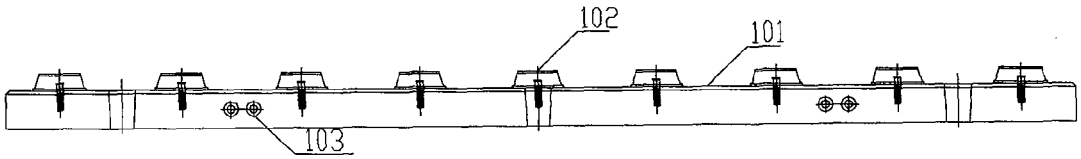
FIG. 10 is a front view structural schematic diagram of the first embodiment of the pre-tensioning pre-stressed concrete track slab of slab-type ballast-less track of the disclosure.
Figure 11:
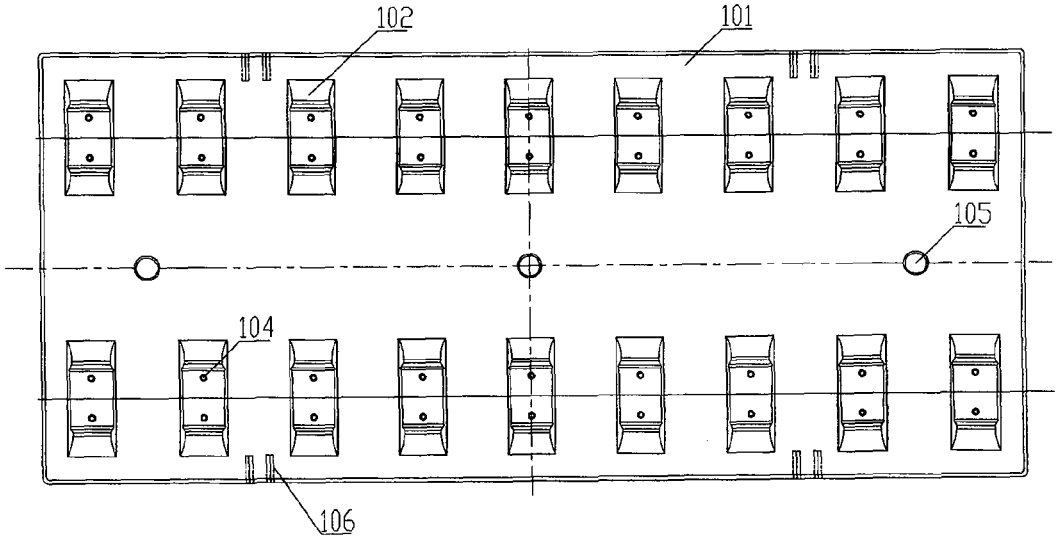
FIG. 11 is a top view structural schematic diagram of the first embodiment of the pre-tensioning pre-stressed concrete track slab of slab-type ballast-less track of the disclosure.
Figure 12:
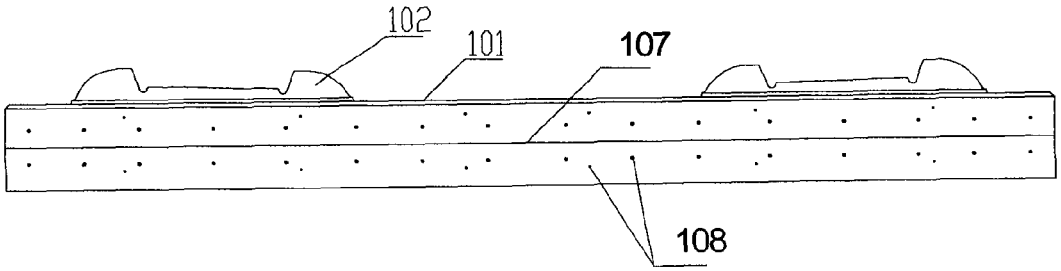
FIG. 12 is a schematic diagram illustrating a pre-stressed steel bar in the first embodiment of the pre-tensioning pre-stressed concrete track slab of slab-type ballast-less track of the disclosure.

FIG. 9 is a structural schematic diagram of the third embodiment of the pre-stressed concrete track slab of slab-type ballast-less track of the disclosure.

As shown in FIG. 9, a hollow portion 29 is provided at the middle portion of the slab body 1 in the third embodiment to solve the disadvantages of relatively heavy dead weight, inconvenient transportation and pavement, high manufacturing cost, and easily generated warping of the track slab caused by daily temperature differences in an integral flat-plate track slab in a ballast-less track structure. The pre-stressed concrete track slab of slab-type ballast-less track in the present embodiment has advantages of light structural dead weight, low manufacturing cost and deformation resistance. By pre-stressing steel bars, the track slab can hardly crack under the design load.

To sum up, the pre-stressed concrete track slab of slab-type ballast-less track of the disclosure has advantages of light structural dead weight, small structure height, low manufacturing cost and deformation resistance.

The First Embodiment of the Pre-Tensioning Pre-Stressed Concrete Track Slab of Slab-Type Ballast-Less Track FIG. 10 to FIG. 14 are structural schematic diagrams of the first embodiment of the pre-tensioning pre-stressed concrete track slab of slab-type ballast-less track.

As shown in FIG. 10 to FIG. 14, the pre-tensioning pre-stressed concrete track slab of slab-type ballast-less track of the disclosure includes: a slab body 101. Fastening embedded casings 104 are arranged on the slab body 101. The distance between fastenings of the steel rail may be regulated by regulating the positions of the fastening embedded casings 104 to adapt to requirements of different operation conditions. Two rows of longitudinal common steel bars 109 and two rows of transverse common steel bars 110 are arranged in the slab body 101 along a length direction and a width direction. Four rows of longitudinal pre-stressed steel bars 108 and one row of transverse pre-stressed steel bars 107 are provided in the slab body 101 along the length direction and the width direction. In the pre-stress directions of the longitudinal pre-stressed steel bars 108 and the transverse pre-stressed steel bars 107, it is pre-tensioned in both directions. Concrete shoulders 102 are further provided on the slab body 101. The concrete shoulders 102 and the slab body 101 may be cast integrally during manufacturing. For the common steel bars 109, 110, measures may be applied, including resin steel bars, or insulating coatings or insulating fasteners etc. In addition, grounding terminals 112 are further provided at the common steel bars to satisfy technical requirements of track circuit insulation, wherein the resin steel bars are steel bars provided with resin coatings on the outer surfaces. In the first embodiment, there are two rows of the longitudinal common steel bars 109 and two rows of the transverse common steel bars 110. However, one or more rows (e.g. three rows) may be arranged if necessary. Similarly, there may be one or more rows of the longitudinal pre-stressed steel bars 108 and the transverse pre-stressed steel bars 107 if necessary. The longitudinal pre-stressed steel bars 108 and the transverse pre-stressed steel bars 107 may be steel rods, steel wires or steel strands. In addition, further, at least one group of hoisting casings 103 is along the length direction provided respectively at both sides of the slab body 101 with respect to the width direction, oppositely. In order to improve the intensities of the hoisting casings 103 and surrounding concrete thereof, spiral reinforcements 106 are further provided in concrete around the hoisting casings 103. Steel bars 111 which extend out of the bottom of the slab body 101, are used to locate, and longitudinally and transversely limit the slab body 101 during line installation. At least one pouring hole 105 for a filling layer, penetrating through the slab body 101, is further provided on the slab body 101 and concrete is poured through the pouring hole 105 to fix the steel bars 111 which extend out. In addition, the disclosure may also arrange semicircular gaps, as the limiting structure, at both shorter edges of the slab body 101, instead of applying the steel bars 111 which extend out. In this case, the pouring hole 105 for the filling layer, penetrating through the slab body 101, is unnecessary. In addition, the concrete shoulders 102 may be also changed into support rail beds. In addition, the concrete shoulders 102 or the support rail beds may not be provided as required.

Figure 13:
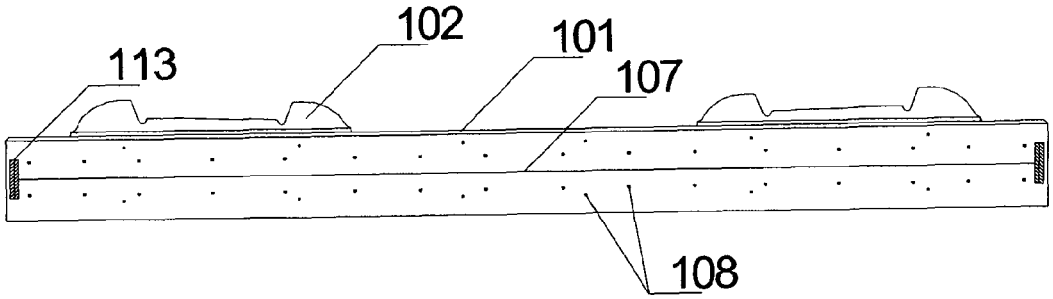
FIG. 13 is a schematic diagram illustrating an anchor backing plate in the first embodiment of the pre-tensioning pre-stressed concrete track slab of slab-type ballast-less track of the disclosure.
Figure 14:
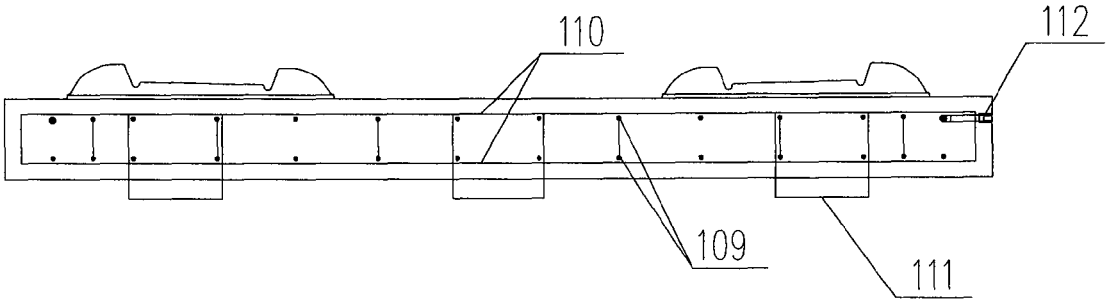
FIG. 14 is a schematic diagram illustrating a common steel bar in the first embodiment of the pre-tensioning pre-stressed concrete track slab of slab-type ballast-less track of the disclosure.

Preferably, the longitudinal pre-stressed steel bars and the transverse pre-stressed steel bars are tightly fixed through anchor backing plates and fastener devices. As shown in FIG. 13, the anchor backing plates 113 are arranged at transverse ends and/or longitudinal ends of the slab body 101.

Figure 15:
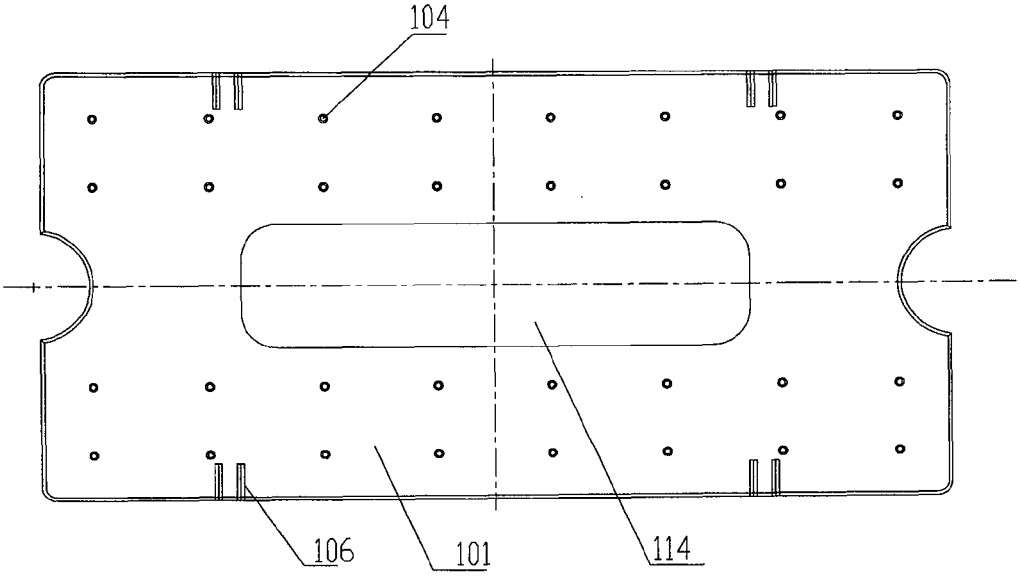
FIG. 15 is a top view structural schematic diagram of the second embodiment of the pre-tensioning pre-stressed concrete track slab of slab-type ballast-less track of the disclosure.

The Second Embodiment of the Pre-Tensioning Pre-Stressed Concrete Track Slab of Slab-Type Ballast-Less Track FIG. 15 is a structural schematic diagram of the second embodiment of the pre-tensioning pre-stressed concrete track slab of slab-type ballast-less track.

As shown in FIG. 15, a hollow portion 114 is provided on a slab body 101 of the pre-stressed concrete track slab as shown in the disclosure to form a pre-stressed concrete frame-type track slab. Since the hollow portion 114 is provided at the middle portion of the slab body 101, the disadvantages of relatively heavy dead weight, inconvenient transportation and pavement, high manufacturing cost, and easily generated warping of the track slab caused by daily temperature differences in an integral flat-plate track slab in a ballast-less track structure are overcome. The pre-tensioning pre-stressed concrete track slab of slab-type ballast-less track of the present embodiment has advantages of light structural dead weight, low manufacturing cost and deformation resistance. By pre-stressing steel bars, the track slab can hardly crack under the action of a design load.

Arrangement, advantages and effect of other structures in the present embodiment are the same as those in the first embodiment, which will not be repeated here.

The above are only preferred embodiments of the disclosure and should not be used to limit the disclosure. For those skilled in the art, the disclosure may have various modifications and changes. Any modifications, equivalent replacements, improvements and the like within the spirit and principle of the disclosure shall fall within the scope of protection of the disclosure.

We claim:

1. A pre-stressed concrete track slab of slab-type ballast-less track, wherein it comprises: a slab body, on which fastening embedded casings are arranged, wherein at least one row of longitudinal common steel bars and at least one row of transverse common steel bars are arranged in the slab body along a length direction and a width direction; the longitudinal common steel bars are insulated from the transverse common steel bars; at least one row of longitudinal pre-stressed steel bars and at least one row of transverse pre-stressed steel bars are fastened in the slab body along the length direction and the width direction through anchor backing plates and fastener devices; one of the pre-stress directions of the longitudinal pre-stressed steel bars and the transverse pre-stressed steel bars is pre-tensioned in one direction and the other one of the pre-stress directions of the longitudinal pre-stressed steel bars and the transverse pre-stressed steel bars is post-tensioned in the other direction; and limiting structures and grounding terminals are arranged on the slab body.

2. The pre-stressed concrete track slab of slab-type ballast-less track according to claim 1, wherein at least one group of hoisting casings is further along the length direction provided respectively at both sides of the slab body with respect to the width direction, oppositely.

3. The pre-stressed concrete track slab of slab-type ballast-less track according to claim 2, wherein spiral reinforcements are further provided in concrete around the hoisting casings.

4. The pre-stressed concrete track slab of slab-type ballast-less track according to claim 1, wherein the longitudinal common steel bars and the transverse common steel bars are resin steel bars.

5. The pre-stressed concrete track slab of slab-type ballastless track according to claim 1, wherein the limiting structures are semicircular gaps provided at both shorter edges of the slab body, respectively.

6. The pre-stressed concrete track slab of slab-type ballastless track according to claim 1, wherein the limiting structures are steel bars extending out of a bottom of the slab body; and at least one pouring hole for a filling layer, penetrating through the slab body, is provided on the slab body.

7. The pre-stressed concrete track slab of slab-type ballastless track according to claim 1, wherein support rail beds are further provided on the slab body; the support rail beds and the slab body are integrated.

8. The pre-stressed concrete track slab of slab-type ballastless track according to claim 1, wherein shoulders are further provided on the slab body; the shoulders and the slab body are integrated.

9. The pre-stressed concrete track slab of slab-type ballastless track according to claim 1, wherein a hollow portion is provided at the middle portion of the slab body.

* * * * *